US005921230A

United States Patent [19]

Vessells et al.

[11] Patent Number: 5,921,230

[45] Date of Patent: Jul. 13, 1999

[54] INSULATING BLANKET FOR A WATER HEATER

[76] Inventors: Joe Vessells; Steve Allen; Ricky Tinnell, all of 40 Wheeler Rd., Bardstown, Ky. 40004

[21] Appl. No.: 09/065,638

[22] Filed: Apr. 23, 1998

[51] Int. Cl.[6] ..... F24H 1/00

[52] U.S. Cl. ..... 126/361; 126/364; 165/156; 165/901; 122/17

[58] Field of Search ..... 126/350 R, 364, 126/365, 344, 389, 373; 165/901, 156, 135; 122/16–19

[56] References Cited

U.S. PATENT DOCUMENTS

| | | | |
|---|---|---|---|
| 4,373,472 | 2/1983 | Kries | 126/350 R |
| 4,398,502 | 8/1983 | Park | 126/364 |
| 4,527,543 | 7/1985 | Denton . | |
| 5,024,210 | 6/1991 | Nelson . | |
| 5,213,728 | 5/1993 | Hickman . | |
| 5,263,469 | 11/1993 | Hickman . | |
| 5,408,832 | 4/1995 | Boffito et al. . | |
| 5,624,726 | 4/1997 | Sanocki et al. . | |

*Primary Examiner*—James C. Yeung
*Attorney, Agent, or Firm*—Kenneth L Tolar

[57] ABSTRACT

The present invention relates to an insulating mechanism for a gas water heater designed to increase the efficiency thereof. The device comprises a blanket formed of a pair of arcuate, adjacent panel members having top and bottom edges with a pair of opposing side edges therebetween. Adjacent side edges of the panel members are hingedly joined with the opposing side edges being selectively attachable to form a cylindrical blanket that encases a water heater storage reservoir. A piping system is disposed within each panel member for circulating waste gas therethrough. An exhaust duct is disposed on the top surface of a water heater outer shell and is in communication with the interior thereof. A hinged baffle divides the duct into an upper and lower chamber both of which are in communication with the piping system. A fan is disposed within the lower chamber and forces hot waste gas from within the outer shell through the blanket and out the top of the duct thereby providing a heated, insulating blanket for the water storage reservoir.

6 Claims, 1 Drawing Sheet

INSULATING BLANKET FOR A WATER HEATER

BACKGROUND OF THE INVENTION

The present invention relates to an insulating assembly for wrapping around a conventional water heater to improve the efficiency thereof.

DESCRIPTION OF THE PRIOR ART

A household water heater generally comprises a cylindrical water storage tank surrounded by a cylindrical outer shell with an annular space therebetween. Because the water storage tank is manufactured with a heat conductive material, an insulating layer is typically placed within the annular space to minimize heat loss. Such insulation generally relates to a layer of foam or fiberglass which provides marginal results.

In a gas fired water heater, hot waste gases generated by the flame are usually exhausted directly from the interior of the outer shell to the atmosphere resulting in significant wasted energy. Accordingly, there is currently a need for a device which can recycle the hot gases generated by a gas flame around the water storage tank providing additional insulation thereto.

Various insulating devices for water heaters exist in the prior art. For example, U.S. Pat. No. 5,624,726 issued to Sanocki et al relates to an insulation blanket comprising a thermal polyolefin protective covering designed particularly for aircrafts.

U.S. Pat. No. 5,408,832 issued to Boffito et al relates to a thermally insulating jacket and a process for producing the same. The jacket is filled with an insulating material, a moisture absorbing material and BaLi4. The jacket is designed primarily for cryogenic vessels.

U.S. Pat. No. 5,263,469 issued to Hickman relates to a method for foam insulating a water heater comprising placing foam flow barriers between the inner tank and outer tank shell around the periphery of the tank fitting openings. Foam forming material is then sprayed into the insulation space whereby the foam barriers prevent the foam from escaping outwardly through the tank fitting openings.

U.S. Pat. No. 5,213,728 issued to Hickman relates to a method for foam insulating a water heater similar to that described in Hickman, supra.

U.S. Pat. No. 5,024,210 issued to Nelson relates to a water heater construction in which insulation material such as fiberglass is placed about the inner tank of the water heater. The insulation material has an annular cuff at its top edge which forms an annular space for receiving an expanded foam material.

U.S. Pat. No. 4,527,543 issued to Denton relates to a water heater including a tank, a cylindrical jacket surrounding the tank and a cover member mounted on top of the jacket to enclose the top of the insulating space. An insulating wall is provided between the tank and jacket comprising a plastic envelope member and a wall of insulating material placed inside the envelope member.

Although various insulation devices for water heaters exist in the prior art, none relate to a device for recirculating hot waste gas through a blanket surrounding the water storage reservoir.

SUMMARY OF THE INVENTION

The present invention relates to an assembly which may be installed onto an existing water heater to increase the efficiency thereof. The device comprises a pair of arcuate panel members hingedly joined at an adjacent side edge with the opposing edges being free allowing the device to be wrapped about the periphery of a water heater storage reservoir and secured thereto to form an encapsulating blanket. Each panel member has a horizontal conduit adjacent its top and bottom peripheral edges in communication with a vertical conduit adjacent each free edge. A plurality of juxtaposed S-shaped tubes interconnect the upper and lower horizontal conduits for circulating waste gas through the panels. An exhaust assembly is installed on the top surface of the water heater outer shell. The exhaust assembly includes an elongated, hollow cylindrical duct having a hinged horizontal baffle therein forming an upper and a lower chamber. The lower chamber is in communication with a first vertical conduit via an intake tube. The upper chamber is in communication with the opposing vertical conduit on the adjacent panel member via an outlet tube. A fan is disposed within the lower chamber for circulating waste gas through the panels. It is therefore an object of the present invention to provide an insulating assembly for a gas water heater that minimizes energy loss from waste gas.

It is yet another object of the present invention to provide an insulating assembly for a gas water heater that is easy to install.

It is yet another object of the present invention to provide an insulating assembly for a gas water heater that increases the efficiency thereof. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
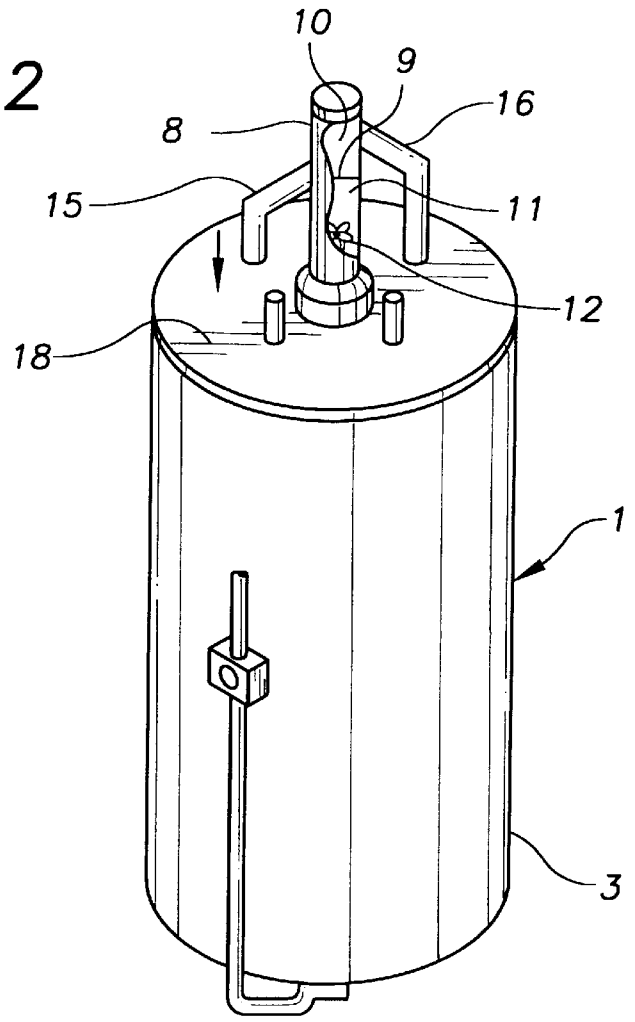
FIG. 2 depicts a perspective view of the outer shell of a water heater with the exhaust mechanism installed thereon.
Figure 1:
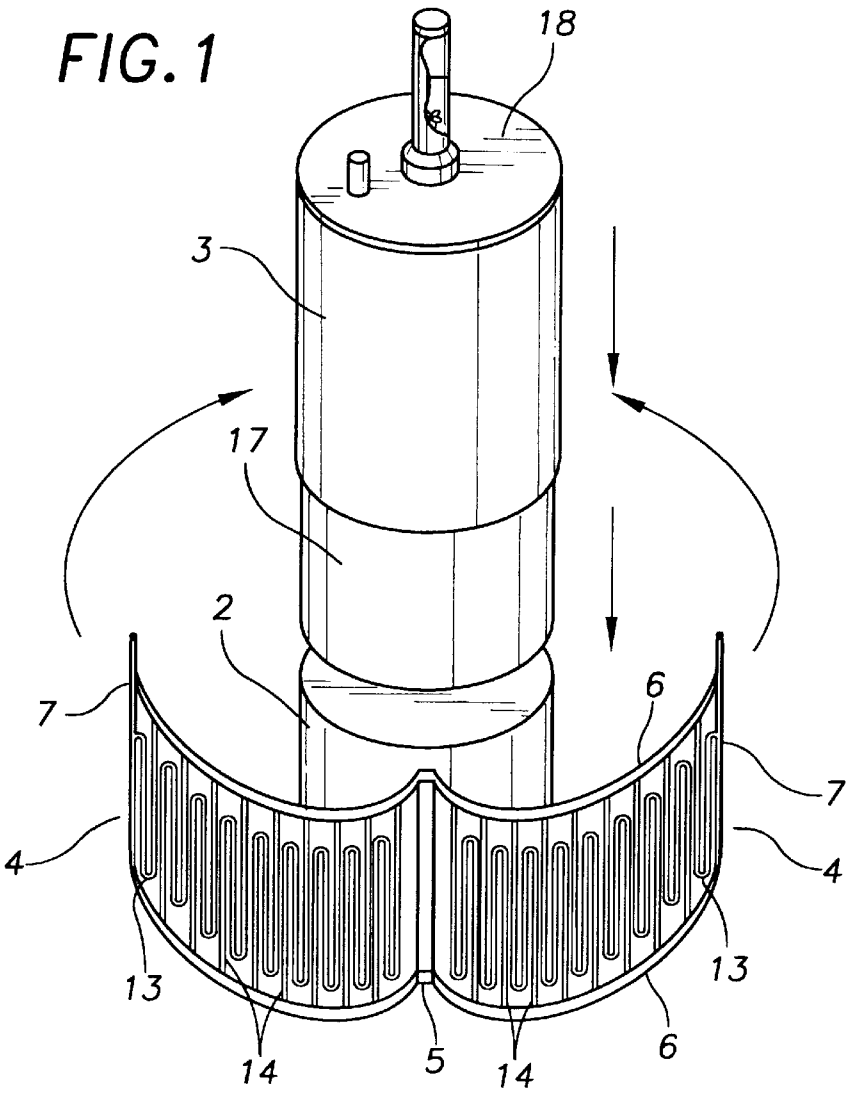
FIG. 1 depicts a partially exploded view of a water heater with the insulating assembly according to the present invention offset therefrom.

Referring now to FIGS. 1 and 2, the present invention relates to an insulating assembly for a water heater 1. A conventional water heater 1 typically comprises a cylindrical water storage reservoir 2 encased by a cylindrical outer shell 3 having a circular top wall 18 with an annular space therebetween. The present invention relates to an insulating assembly designed for a conventional water heater as described above.

The device comprises a blanket member formed from a pair of adjacent arcuate panels 4 having top and bottom edges with a pair of opposing side edges therebetween. The panels are hingedly joined 5 at adjacent side edges with the opposing side edges being removably joined using any conventional attachment means. Within each panel proximal the top and bottom edges is a substantially horizontal conduit 6 each in communication with a vertical conduit 7 along its free edge thereof. Outer S-shaped tubes 13 extend from each vertical conduit to the top horizontal conduit on each panel member. A plurality of juxtaposed S-shaped tubes 14 are disposed between the two outer S-shaped tubes and interconnect the top and bottom vertical conduits providing a pipe assembly for circulating a gas through the blanket member.

Attached to the top wall of the outer shell of the hot water heater is a hollow cylindrical exhaust duct 8 in communication with the interior of the shell having an open top end in communication with the atmosphere. Within the interior of the exhaust duct is a hinged, horizontal baffle 9 segregating the duct into an upper 10 and a lower chamber 11. Within the lower chamber 11 is an electrical fan 12 for circulating waste gas flow from within the outer shell to the panels. The fan may also be in communication with a thermostat for automatic activation. An intake tube 15 is directed from the lower chamber to a first vertical conduit on a panel member. An outlet tube 16 is directed from the upper chamber to the second vertical conduit on the opposing panel member.

Accordingly, the arcuate panels are placed within the annular space and we secured about the periphery of the water storage reservoir with the intake and outake tubes attached thereto as described above. When the gas water heater is activated, the fan will direct hot waste gases through the panels via the intake tube thereby providing a heated, insulating blanket around the water storage reservoir. Once the waste gas has been circulated through the panels, the gas will flow to the atmosphere via the outlet tube. Accordingly, hot waste gases normally expelled directly to the atmosphere will be recirculated about the periphery of the water heater thereby increasing the efficiency thereof.

The arcuate panel members may be covered with a layer of foam insulation 17 or a similar material to further enhance the insulating qualities thereof. Preferably, the inside of each arcuate panel is made with a conductive material while the opposing side is made with a non conductive material. The gas recirculation piping system may stand alone or may be encased within a covering of foam, fiberglass or a similar insulating material and its configuration may be varied; for example, one or more tubes may be helically wound about the water storage reservoir without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a water heater having a heat source that produces hot waste gas and a cylindrical water storage reservoir, both received within a cylindrical outer shell having a top wall, an insulating assembly comprising:

a blanket secured about the periphery of the water storage reservoir, said blanket having a piping assembly therewithin, said piping assembly having a gas inlet and a gas outlet;

an exhaust duct attached to the top wall of said outer shell, said duct including a first chamber in communication with both the hot waste gas and with the piping assembly inlet for circulating hot waste gas therethrough, said exhaust duct further including a second chamber in communication with the piping assembly outlet and the atmosphere;

a gas circulation means received within one of said chambers for inducing the waste gas to flow from said first chamber through said piping assembly to said second chamber where it is expelled to the atmosphere.

2. An insulating assembly according to claim 1 wherein said blanket comprises a pair of adjacent arcuate panel members, each panel member having arcuate upper and lower edges with two side edges therebetween, a first side edge of a panel being immediately adjacent a first side edge of the adjacent panel and hingedly joined thereto, the second side edges of each panel being free and selectively joinable to surround the exterior of said water storage reservoir.

3. An insulating assembly according to claim 2 wherein said piping assembly comprises:

top and bottom horizontal conduits adjacent the top and bottom edges of each panel, respectively;

first and second vertical conduits disposed between the top and bottom horizontal conduits and in communication therewith, the first vertical conduit in communication with the first chamber in said exhaust duct and the second vertical conduit in communication with the second chamber;

a pair of outer S-shaped tubes each in communication with a select vertical conduit and an adjacent horizontal conduit;

a plurality of juxtaposed S-shaped tubes disposed between said outer S-shaped tubes each in communication with the top and bottom horizontal conduits for directing the hot waste gas along a tortuous path through said panels.

4. An insulating assembly according to claim 1 wherein said gas circulation means is a fan.

5. An insulating assembly according to claim 1 further comprising a horizontal baffle received within said duct which segregates said duct into said first and second chambers.

6. An insulating assembly according to claim 5 wherein said baffle hingedly engages said exhaust duct.

* * * * *